US005140562A

United States Patent [19]

Moore-Ede et al.

[11] Patent Number: 5,140,562

[45] Date of Patent: Aug. 18, 1992

[54] BIOLOGICAL TIMEPIECE

[76] Inventors: Martin C. Moore-Ede, 110 Hundreds Rd., Wellesley Farms, Mass. 02181; Ross E. Mitchell, 4 Allston St., Newtonville, Mass. 02165-2554

[21] Appl. No.: 668,966

[22] Filed: Mar. 13, 1991

[51] Int. Cl.[5] ..... G04B 19/00; G04B 25/00

[52] U.S. Cl. ..... 368/62; 368/11; 368/76; 368/223

[58] Field of Search ..... 368/10, 11, 62, 76, 368/80, 82-84, 107, 155-157, 223, 228

[56] References Cited

U.S. PATENT DOCUMENTS

| | | | |
|---|---|---|---|
| 4,665,086 | 5/1987 | Short et al. | 514/416 |
| 4,763,311 | 8/1989 | Marvosh | 368/223 |
| 4,858,609 | 8/1989 | Cole | 128/395 |
| 4,893,291 | 1/1990 | Bick et al. | 368/10 |
| 4,911,166 | 3/1990 | Leighton et al. | 128/380 |
| 4,995,020 | 2/1991 | Mitchell | 368/185 |
| 5,031,161 | 3/1991 | Kendrick | 368/29 |
| 5,058,085 | 10/1991 | Lawler | 368/28 |

FOREIGN PATENT DOCUMENTS

| | | |
|---|---|---|
| 3708578 | 3/1987 | Fed. Rep. of Germany . |
| 3613889 | 4/1987 | Fed. Rep. of Germany . |

*Primary Examiner*—Vit W. Miska

*Attorney, Agent, or Firm*—David Pressman

[57] ABSTRACT

A timepiece for continuously calculating and displaying the actual biological time of day of an individual. After an initial biological time of day is entered, the timepiece runs at a pre-determined rate corresponding to the rate at which time would progress in a free-running circadian clock for the individual. When the individual is exposed to clock-altering stimuli, such as bright light, the timepiece computes a new operation rate based upon the relative effects of the clock-altering stimuli as determined by a phase response curve for the individual. By combining information concerning the presence or absence of clock-altering stimuli with information concerning the effects of that stimuli, the watch is able compute and continuously display the individual's accurate biological time.

19 Claims, 4 Drawing Sheets

PHASE RESPONSE FUNCTION

BIOLOGICAL TIMEPIECE

BACKGROUND

Cross-Reference to Related Application

This application is related to U.S. application Ser. No. 07/520,260 of Ross E. Mitchell, now U.S. Pat. No. 4,995,020, which is a continuation-in-part of an application which matured into U.S. Pat. No. 4,956,820, itself a continuation of an application which matured into U.S. Pat. No. 4,901,296. The contents of each of these patents are hereby incorporated by reference.

Field of Invention

This invention relates generally to timepieces, particularly to timepieces especially suited for individuals experiencing a change of applicable time standards caused by their exposure to biological time-altering stimuli, such as bright light, or by a change in work-rest schedule.

Description of Prior Art

Biological clocks in the brain are responsible for timing sleep and wakefulness, alertness and performance, across the twenty-four hour day. In the modern world, millions of people are required to work and sleep at non-standard times of day, resulting in sleep disorders, fatigue, ill health, jet lag, and a plethora of social and work related problems. New techniques for resetting the biological clock are being developed, including bright light, melatonin, and pharmacological agents; however, the efficacy of treatments which alter or reset biological time depends on precise knowledge of the subject's current biological time which may be positioned at any phase relationship to standard environmental time (local time).

It is now known that exposure to bright light at certain periods of the biological day will cause a shift in the biological clock of an individual. Depending upon the period within the day that the exposure to light occurs, the effect will either be to "speed up" the biological clock (phase advance), or to slow it down (phase delay).

"Biological Time" is an indication of the relative positioning of an individual's biological clock with respect to the timing of a pre-determined phase of the circadian cycle, such as, the minimum of the circadian rhythm of core body temperature or the time of normal awakening from sleep. This Biological Time may be expressed as a time of day or a circadian phase in degrees. The circadian period in humans is known to be approximately 25 hours in standard timekeeping hours, herein referred to as "standard hours."

In the free-running circadian clock of a human, that is to say, an individual who lives unexposed to daylight, the standard environmental time of day would, thus, be later and later as compared to the biological time of day. Extensive scientific experimentation has confirmed this in hundreds of human subjects.

Thus, in a free-running clock, the biological time of day will not correspond with the standard environmental time of day. However, in a normal environment, individuals, in their first waking hours, are exposed to bright morning light during a period when their biological clocks will be phase advanced by exposure to this light. This, in fact, causes their biological clocks to run temporarily faster than normal, so that they gain back the lost hour each day and, in effect, reset their biological clocks to correspond with the current local time.

The biological time when the biological clock is phase advanced or phase delayed by exposure to light is described by a Phase Response Curve (PRC). Experimental studies in animals and humans have defined PRC's to a variety of specific biological clock-altering stimuli, such as light, pharmaceutical drugs, melatonin, and certain other specific stimuli.

The above Mitchell patents describe a watch which runs at a modified rate in order to permit a user to gradually adapt to a new time standard during a given adaptation period. The rate at which this timepiece runs during the adaptation period is either entered by the user or calculated by the watch based on the difference between the applicable time standards. This watch does not contain any means for indicating what rate modification factor should be used based on an individual's biological phase response curve (PRC). Nor does this timepiece permit the user to specify the effect of various intensities of the biological clock-altering stimuli.

Another example of a timepiece capable of functioning at an altered rate is found in German Patent 3 708 578 to Joschko (1987). This patent describes a timepiece which can run at a variable rate in order to eliminate the need to set clocks forward in summer to take advantage of the additional daylight provided by the longer summer days. This timepiece is typically set to run at an altered rate between two dates so that the timepiece will run faster for part of a one year period, then slower for the remainder of that one year period in such a way as to cause a particular time of day to be progressively later (when compared to a timepiece running at normal speed), then progressively earlier, until, at the end of the one year period, the indicated time would once again agree with a clock which had been running at a normal rate throughout the year.

Similarly, Marvosh, in U.S. Pat. No. 4,763,311 (1989), describes a double clock, one face of which runs at a fast or slow rate for six months of each year. As with the Joschko timepiece, the purpose of this clock is to gradually alter the user's time standard in order to take advantage of all available daylight throughout the year. Neither of these timepieces addresses the aforenoted needs of an individual.

In German Patent No. 3 613 889 to Szecsi (1987), a "Biological Watch" timepiece is described. This timepiece contains built-in sensors which measure and evaluate human biological parameters, such as blood pressure, pulse rate, body temperature, etc., and in response to abnormally high or low values of these parameters, will vary the operation rate of the timepiece. So, for example, on individuals with abnormally high blood pressure, the timepiece will run faster than normal. The purpose of this is to alert users to the fact that they are losing time from their lives due to their unhealthy lifestyle. Their life expectancy is shortened by the fact that their blood pressure is high, so Szecsi proposes that they be alerted to this fact by the display's running faster than normal. This timepiece does not in any way deal with true biological time as defined above nor does it address any of the issues of the circadian timing system (body clock), PRC, or biological clock-altering stimuli.

Numerous devices have been patented to enable individuals to adapt their biological clocks to a new time standard.

One such device is described in U.S. Pat. No. 4,911,166 to Leighton et al. (1990). This device consists of a visor which shines bright light into the subject's eyes so as to replace the stimuli normally applied by daylight. Use of this device to alter biological time is currently being evaluated for use with jet lag and shift work.

Another such device is described in U.S. Pat. No. 4,858,609 to Cole (1989). This invention consists of a bright light mask system for shining a high intensity light into a subject's eyes at pre-selected time periods in order to modify circadian rhythms.

Another method which is being studied consists of the administration of melatonin to alleviate the effects of disturbances in circadian rhythms caused by travel (jet lag). U.S. Pat. No. 4,665,086 to Short and Armstrong (1987) describes this method of dealing with circadian-rhythm disruption, and offers some hope for the development of a pharmacological means of altering the biological clock.

In U.S. Pat. 4,893,291 to Bick and Kinnell (1990), a device for determining the appropriate times for a traveler to be exposed to (or to avoid exposure to) daylight in order to adapt his or her biological clock to a new time standard is described. A crude and inaccurate phase response curve is used to indicate when exposure to daylight will cause the biological clock to phase advance, phase delay, or remain unchanged. This device is merely used to suggest a treatment consisting of exposure to daylight or avoidance thereof.

None of the above biological devices provides information to users concerning their current positioning within the circadian cycle. They further, give no readable indication of the effects of treatment on the individual's biological time of day, nor do any of the references provide an indication of current biological time of day.

OBJECTS AND ADVANTAGES

Accordingly, one object of this invention is to provide a timepiece which will enable the user to continuously track at which point within the circadian cycle an individual's biological clock is currently positioned.

A further object is to provide a timepiece which will permit the user to dynamically monitor the effects of treatment to the biological clock of an individual.

It is also an object to provide a timepiece which can calculate and display an accurate biological time of day for an individual.

Another object is to provide a timepiece which automatically alters its rate so as to run at a rate corresponding to the rate at which biological time is advancing (or regressing) for an individual.

A, still further object is to facilitate treatments aimed at resetting the biological clock of an individual to synchronize it with a desired time standard through the timepiece's ability to dynamically calculate the biological time and take into account the treatments to which the user has been exposed.

Further objects will become apparent from the ensuing description, claims and accompanying drawings.

GENERAL DESCRIPTION

In accordance with the present invention, an electronic timepiece is provided which is capable of calculating and displaying the actual biological time of day of an individual. To use the timepiece, the user enters the current biological time of day of an individual. This time can be determined by estimates based on local time of day, work shift schedule, or by direct physiological measurement. The user of the timepiece can be the individual whose biological time is being tracked, or can be another person, such as a doctor treating the individual.

Once the initial biological time has been entered, the timepiece begins to run at a pre-determined rate corresponding to the rate at which time would progress in a free-running circadian clock for the individual. This rate can be provided as a default parameter which may be alterable on some embodiments of the timepiece.

When the user is exposed to clock-altering stimuli, such as bright light, this fact is indicated to the timepiece in one of several ways. The user can operate a button on the timepiece to indicate that the clock-altering stimuli is being applied, or this can be determined by direct measurement, such as through the use of a light sensor to indicate that the user is being exposed to bright light.

At this point, the timepiece consults a matrix, the values of which are derived in part from a Phase Response Curve (PRC). This matrix provides the Phase Response Function (PRF) which indicates the new rate at which the timepiece should function, given the effect of the absence or presence of clock-altering stimuli on the biological clock of the user. This rate can be expressed as a percentage of normal speed, e.g., 200 can denote twice normal speed, or it can be any other representation of an operation rate. If the treatment occurs during the phase delay portion of the PRC, the timepiece may even run backwards if the rate of delay of the user's biological clock exceeds the rate of advancement of standard environmental time. Thus, in this instance, the rate can be expressed as a negative number, e.g., −50 would indicate that the timepiece should run backwards at a rate of 50% of normal speed.

In one embodiment, the watch consults the phase response curve on a regular basis in order to continuously modify the operation rate as the user passes through different phases of the PRC. The watch can also be configured to use the initially retrieved operation rate as a static rate to be used throughout the treatment period.

The timepiece is optionally configured with means for adjusting this operation rate based on the intensity of the clock-altering stimuli. For example, if the user is being treated with light of an intensity of 3,000 lux, the watch can run at one rate, while if the intensity of the light is 10,000 lux, the watch can run at a different rate.

Many different implementation means for this "dose sensitive" rate adjustment can be envisaged. The various rates at different dose levels can be stored in a two-dimensional phase response curve matrix, with the first dimension denoting biological time, and the second dimension denoting intensity. The value found at the intersection represents the operation rate. Another way to implement this feature is through the use of a rate adjustment algorithm using the intensity to modify the value found in the PRF table.

It is important to note that the timepiece is not limited to the use of pre-stored PRC information. In addition to storing PRC information, this data can equally as well be determined through the use of a desired algorithm.

At some points in the biological day, application of bright light as clock-altering stimuli will have no effect. This range of the PRC is referred to as the "dead zone." The operation rate of the watch will not change from the default if the user's current biological time falls within this range.

When the biological clock-altering stimuli is removed, the watch will return to its normal operation rate, that is, the rate necessary to express a free-running circadian period as twenty-four hours. In the case of a human with a 25 hour circadian period, this operation rate will be 96% of normal environmental clock speed. Thus, without the benefit of clock-resetting stimuli, the user's biological 8:00 AM, for example, would be one standard hour later each day.

The preferred implementation of the biological timepiece includes a microprocessor circuit and associated function switches and (optionally) sensors which receive the input data and make the necessary calculations described above to develop the timing signals to drive the watch display at the called for rate. The electronic circuitry for doing this is well known in the art so that the incorporation of the invention into an otherwise conventional electronic timepiece should not unduly complicate the timepiece or materially add to its overall cost.

DESCRIPTION

FIG. 1—BLOCK DIAGRAM OF SYSTEM

Figure 1:
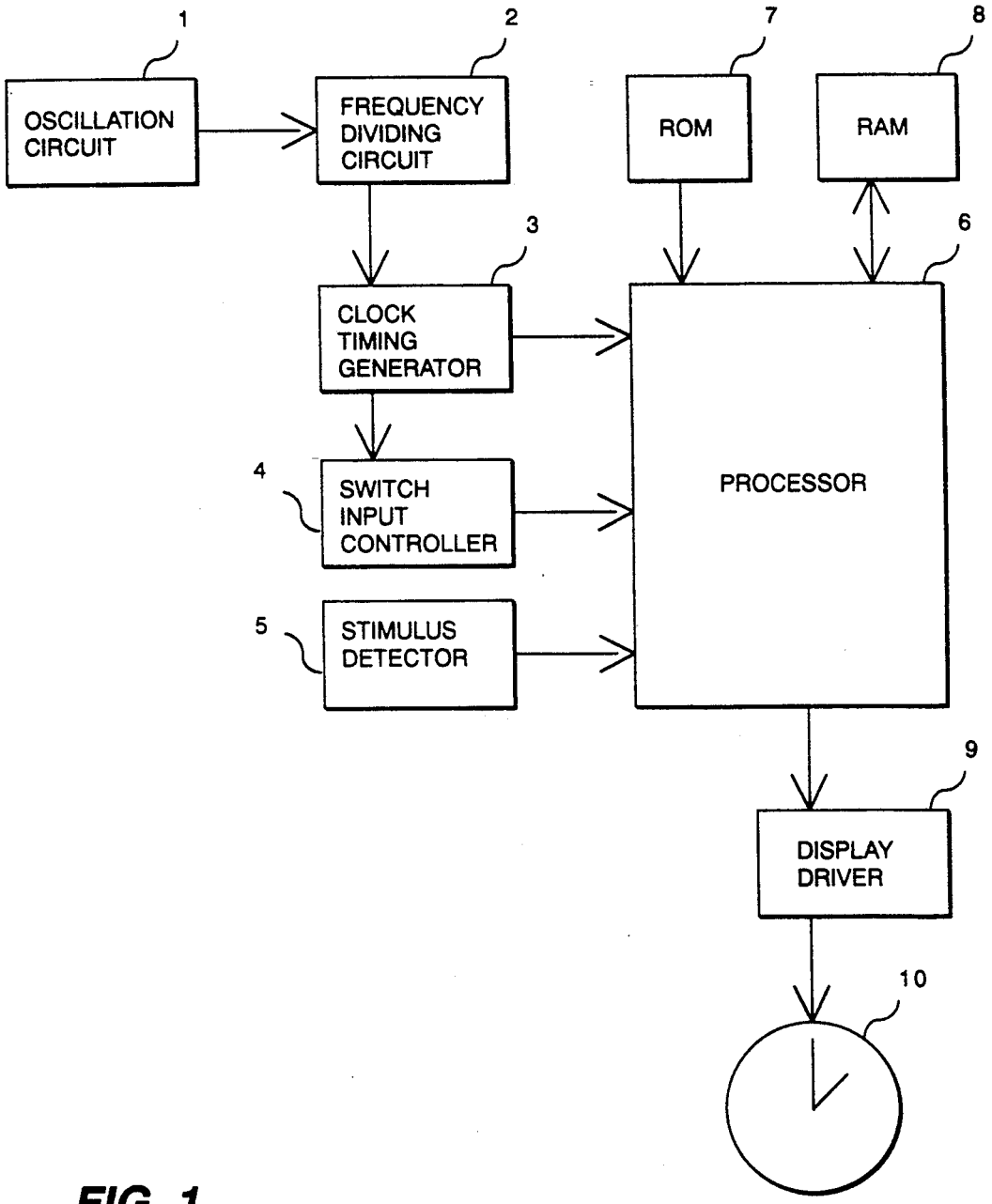
FIG. 1 is a block diagram illustrating one embodiment of the present invention.

FIG. 1 is a block diagram which illustrates one embodiment of the present invention, wherein reference numeral 1 denotes an oscillation circuit including a quartz oscillator source. Frequency-dividing circuit 2 divides the frequency of outputs of the oscillation circuit 1. Clock timing generator 3 generates timing clock signals necessary for operating the whole system in response to the outputs of frequency-dividing circuit 2. Switch input controller 4 controls the switch input depending upon the timing determined by clock timing generator 3. The biological clock-altering stimulus detector 5, which in this embodiment is a light sensor, detects the presence of light of various intensities. Processor 6 calculates and controls the timepiece. The instructions used to control the processor as well as static data, such as a phase response curve matrix are stored in ROM 7, while RAM 8 stores dynamic data, such as the current time, operation rate, etc. Display driver 9 drives the hands of the display 10.

FIGS. 2 AND 3—OPERATION OF THE TIMEPIECE

Figure 2:
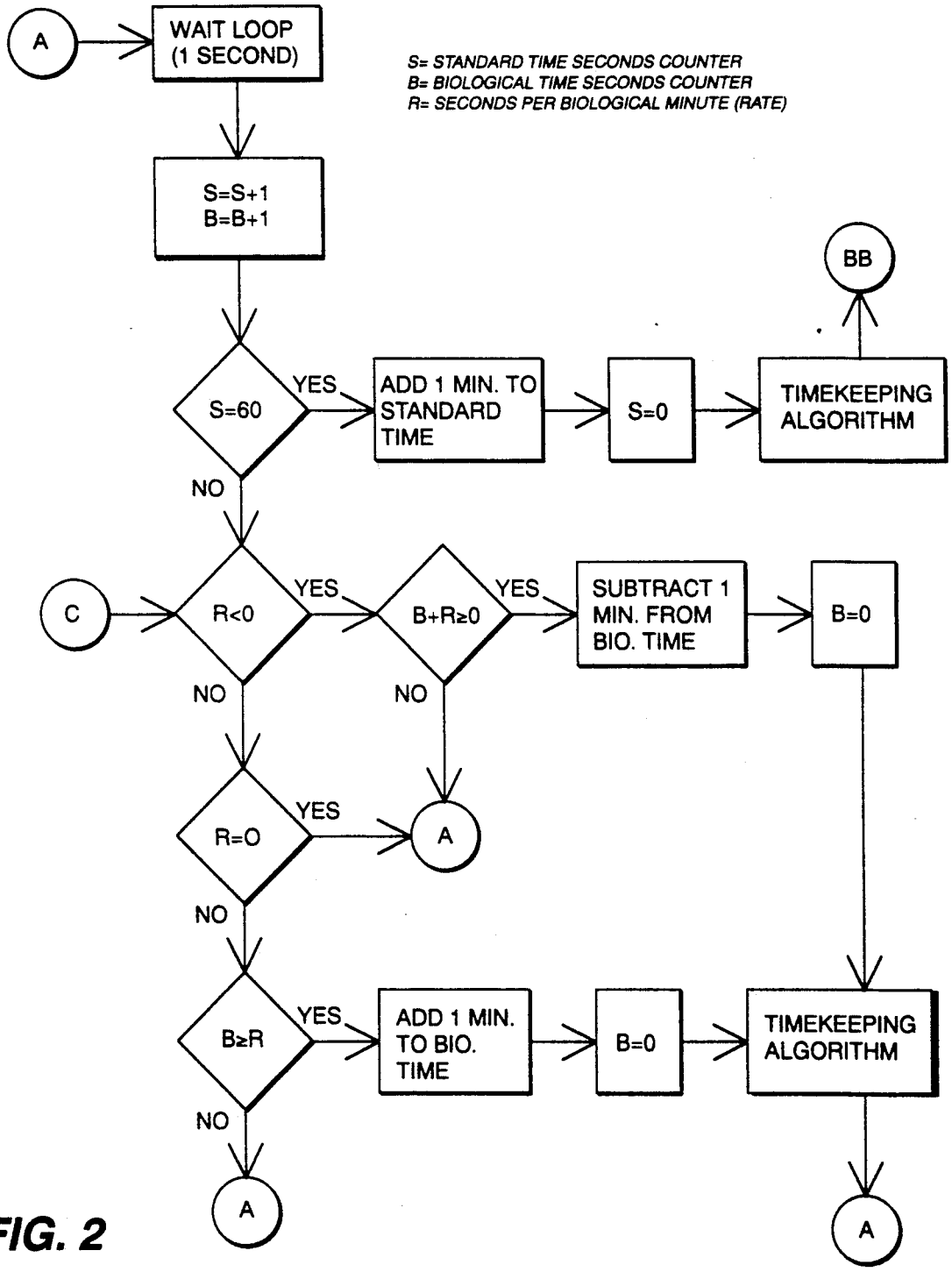
FIGS. 2 and 3 are flow charts illustrating the procedure of data processing executed according to the present invention.
Figure 3:
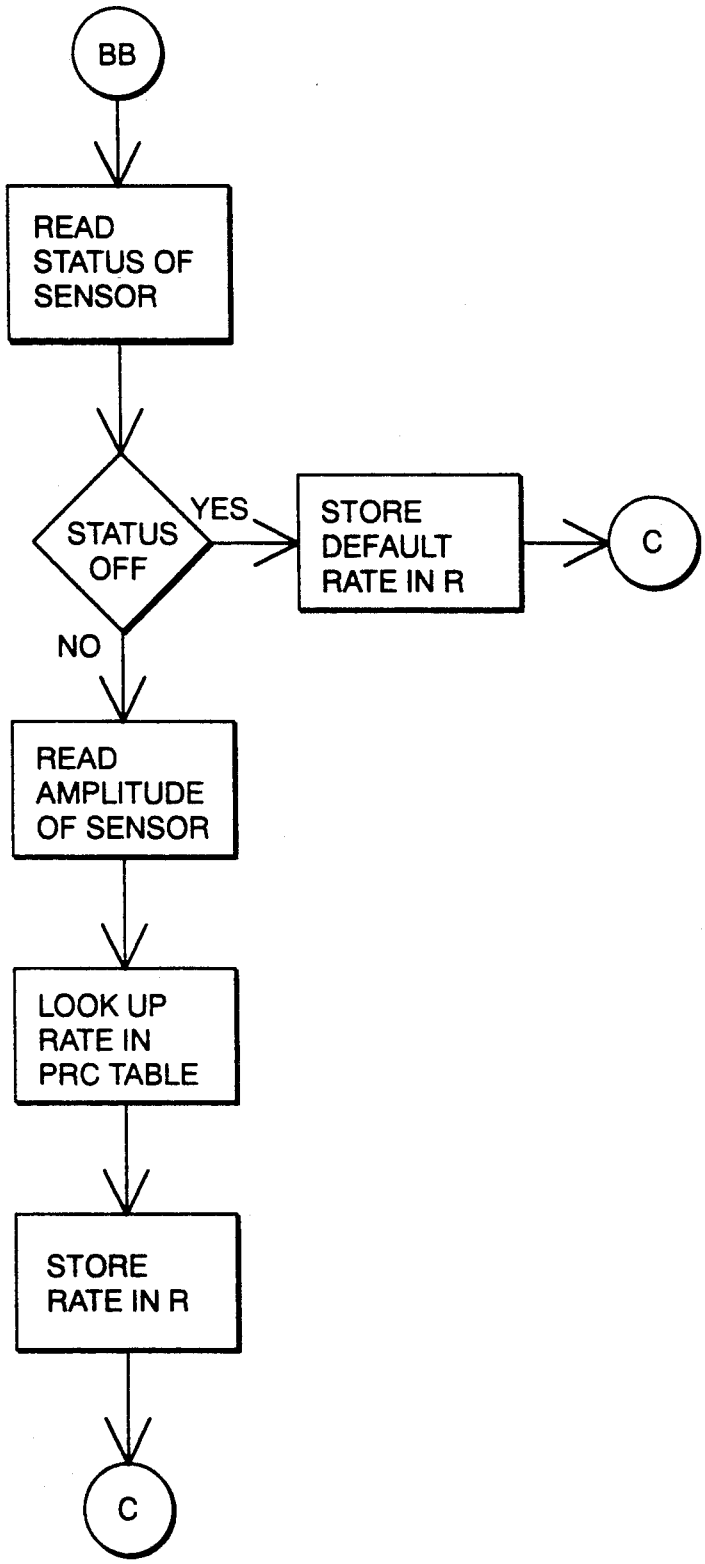

The principle of the present invention is best understood by consideration of the flow charts in FIGS. 2 and 3. FIG. 2 illustrates how the determination of the operation rate of the timepiece is made.

During operation, a wait loop is entered at A. In response to one hertz signals produced by the clock timing generator 3 (FIG. 1), the wait loop is exited and one second is added to the normal (environmental) and biological times. The standard time seconds counter (S) is then tested for equality with 60 in order to determine if one standard rate minute has elapsed. If so, one minute is added to the standard time, the counter S is reset, and control is passed to the logic of FIG. 3. If one minute has not elapsed, processing continues with the determination of whether the biological time is advancing or regressing.

Memory location R contains the current number of standard rate seconds in a biological minute. The initial value of R has been set to the default operation rate of the biological clock of the individual in logic which is not shown due to its conventionality. The value in R will be updated each minute based on the absence or presence of biological clock-altering stimuli and the current positioning of the individual on the phase response curve. If the value stored in R is negative, this indicates that the biological time indication is actually regressing at the rate of R seconds per biological minute. If the value of R is zero, the biological clock of the user is stopped. If the value of R is positive, then biological time is advancing at the rate of R seconds per biological minute.

Memory location B stores the number of seconds which have elapsed since the incrementing (or decrementing) of biological time. When biological time in advancing, and the value in B equals or exceeds the value of R, then the biological time is incremented by one minute and the value of B is reset to zero. If biological time is regressing, the value of B is tested to see whether it, when added to R, is equal to or greater than zero. If so, this indicates that a "biological minute" has elapsed wherein the biological minute represents time regressing for the user. In this case, one minute is subtracted from the biological time and the value of B is reset to zero. In both cases, a "timekeeping algorithm" is then executed. This is a routine for incrementing (or decrementing) hours and dates at the proper time. All electronic timepieces must perform this function and its operation is well known in the art.

In FIG. 3, the routine for dynamically adjusting the rate as a function of the absence or presence of clock-altering stimuli and positioning on the phase response curve is described. In the present embodiment, this routine is executed once per standard minute. The status of the clock-altering stimulus detector 4 (FIG. 1) is read. If there is no biological clock-altering stimulus being applied, i.e., if a minimum threshold level of light is not present, then the default free-running operation rate for the watch will be stored in register R. In the present embodiment, this clock-altering stimulus sensor consists of a light sensor; however, it can simply be indicated by the setting of a switch by the user, as has been previously mentioned. Once it is determined that light of a sufficient level to alter the biological time is being applied, the level of this light is read. Then using this value in conjunction with the current biological time of the user, the appropriate rate value is read from the phase response curve matrix. This new rate is then stored in register R and processing continues at letter C of FIG. 2.

FIG. 4—REPRESENTATION OF THE PHASE RESPONSE CURVE

Figure 4:
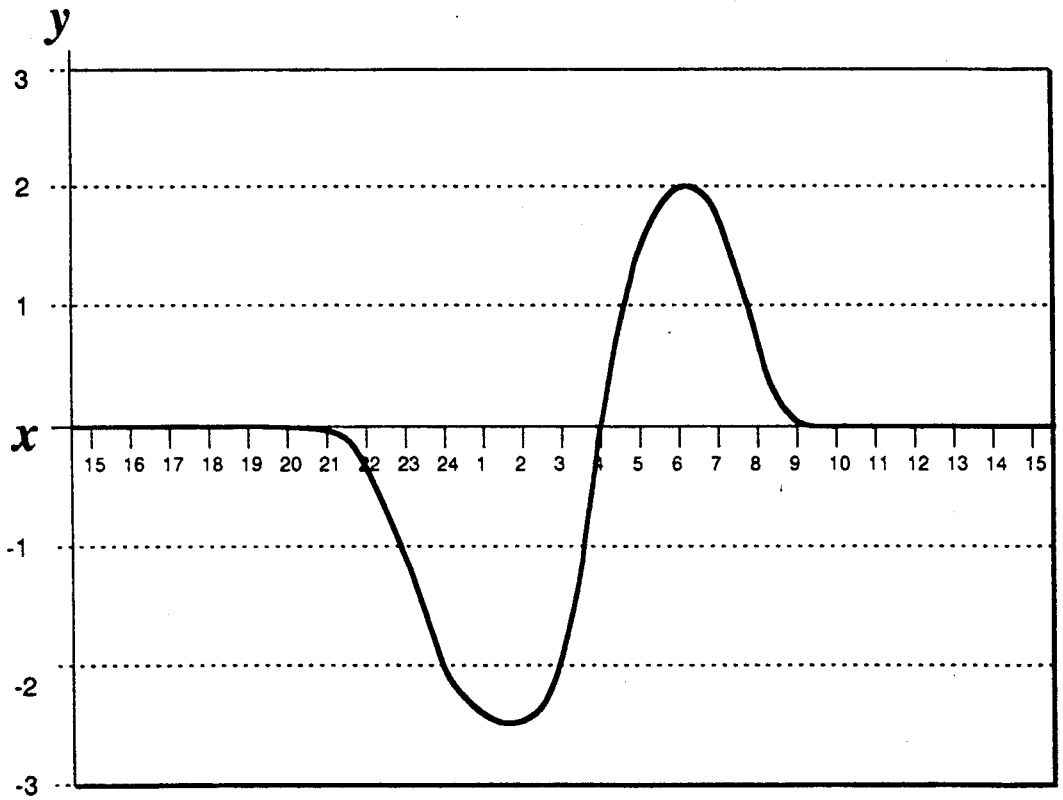
FIG. 4 is a graphical representation of a typical phase response curve for the circadian clock of an individual.

FIG. 4 shows a phase response curve for a typical individual. In this example, the phase response curve has been converted to a phase response function wherein the Y axis denotes the adjustment to the normal rate of time advancement of the individual while the X axis denotes various times of the biological day. When the value of Y is 0, this indicates that clock-altering stimuli, such as light, will have no effect on the rate of advancement of the biological clock of the individual.

Positive Y axis numbers, in this example, represent an increase in the rate of time progression of the biological clock of the individual. Level one represents biological time running at a rate twice normal speed; two indicates three times normal speed, etc. Negative Y axis numbers below −1 indicate speeds of regression of biological time. The value "−1" means that the biological clock of the individual will, in fact, be stopped, since the adjustment rate of regression equals the standard rate of advancement. Values between 0 and −1 will cause biological time to advance, albeit at a slower rate than standard environmental time. Values below −1 will cause the biological time of the individual to actually regress in real terms!

It is a simple matter to convert this chart to a numerical representation suitable for storage in ROM or RAM in the present embodiment. This stored table of values is then consulted (FIG. 3) to determine the appropriate operation rate for the timepiece.

USES OF THE TIMEPIECE

This timepiece can be used in treating sleep disorders. Doctors, through the use of the invention, can have immediate information concerning the effects of light therapy on the biological time of their patients.

Light treatment booths for travelers which are equipped with our timepiece will afford users the opportunity to know what their biological time has become throughout and at the end of their light treatment. This is important since an individual spending two hours in such a booth at one point in the biological day would experience a very different effect on his biological time than if the light treatment were carried out at some other time in the biological day.

Systems for use in the home can also incorporate the invention; in short, wherever an effect on the biological time of day can be caused by application of some clock-altering stimuli, our timepiece can calculate and display the changing biological time.

CONCLUSIONS, RAMIFICATIONS, AND SCOPE

Thus it is seen that our timepiece is capable of calculating and displaying actual biological time of an individual. The timepiece accomplishes this task by combining information concerning the absence or presence of biological clock-altering stimuli with information concerning the effects of the stimuli (PRC), so as to determine a proper rate of advancement (or regression) of biological time. The knowledge of the biological time can be used in a wide variety of applications.

It follows, therefore, that our timepiece can be used as a basic part of any device which treats people with light or any other biological clock-altering stimuli, thereby providing immediate and accurate representation of the user's biological time.

The timepiece can also incorporate the ability to run at the standard environmental rate when the biological time function is not enabled. However, it should be understood that the capability to run at a standard rate is not a required component of the timepiece.

Inputs denoting the presence or absence of biological clock-altering stimuli can also be varied. This can be user-entered, or it can be determined by such things as light sensors, etc. Furthermore, the intensity of the clock-altering stimuli can also be received and used in the calculation of the biological time progression rate.

In line with this, many representations and calculations of the PRC can be envisioned. For example, the PRC can be based on phase and amplitude; a Limit Cycle Model of the biological clock can be used as well as other oscillator models of a biological clock. Therefore, any combination of factors resulting in a PRC should be considered as falling within the scope of this invention.

The input of current biological time need not be a manual entry. Embodiments of the invention can be developed wherein this value can be derived from a biological sensor which measures a physical or chemical parameter of a circadian rhythm, such as core body temperature.

Instead of a visual display, the value of the current biological time of the individual can, for example, be stored in a computer, transmitted by telecommunications device, or even used as input to other devices.

The device can also be confiugured to permit resetting of biological time to the current standard environmental time, so that differences between the two can be eliminated without the need to re-enter current standard environmental time. This can be accomplished by simply pressing a button which sets biological time equal to environmental time.

Multiple simultaneous time displays are also possible, with one display being the inidividual's current environmental time and another being the current biological time. Even on timepieces with only one display, the user may be permitted to switch between biological time and standard time in similar fashion to that of any dual or multi-zone timepiece.

Others can, by applying current knowledge, readily modify and/or adapt this embodiment for various applications without departing from the generic concept, and, therefore, such adaptations and modifications should and are intended to be comprehended within the meaning and range of equivalents of the disclosed invention. It is to be understood that the phraseology or terminology employed herein is for the purpose of description and not of limitation. Therefore, the scope of this invention should be determined by the appended claims and their legal equivalents and not by the examples given.

We claim:

1. A timepiece for continuously calculating and displaying the current biological time of an individual having a phase response curve and a biological time cycle, comprising:
   - input means for entering an initial biological time for said individual;
   - storage means for storing data representing said phase response curve of said individual;
   - calculation means for determining and applying a rate of advancement or regression of biological time of said individual based upon said phase response curve;
   - output means for indicating a current biological time of said individual.

2. The timepiece of claim 1, further including detection means for detecting the presence of biological clock-altering stimuli to which said individual is subjected, and wherein said calculation means is also arranged to receive an output of said detection means and determine said rate of advancement or regression of said biological time based upon said phase response curve and the output of said detection means.

3. The timepiece of claim 2 wherein said detection means consists of a light sensor.

4. The timepiece of claim 2 wherein said detection means consists of a manually operated switch.

5. The timepiece of claim 2 wherein said detection means is arranged to detect the intensity of said biological clock-altering stimuli.

6. The timepiece of claim 1 wherein said input means is also arranged to permit entry of data representing a default operation rate for said timepiece, said input means including means for operating said timepiece at said default operation rate in the absence of said biological clock-altering stimuli.

7. The timepiece of claim 1 wherein said calculation means is also arranged to indicate a time representing the advancement of time at a standard rate.

8. The timepiece of claim 1 wherein said output means comprises means for driving a display for indicating time to said user.

9. A timepiece for continuously calculating and displaying the current biological time of an individual having a phase response curve and a biological time cycle, comprising:

input means for entering an initial biological time for said individual;

storage means for storing data representing said phase response curve of said individual;

detection means for detecting the presence of biological clock-altering stimuli to which said individual is subjected;

calculation means for determining and applying a rate of advancement or regression of biological time of said individual based upon said phase response curve and said biological clock-altering stimuli, when present;

output means for indicating a current biological time of said individual.

10. The timepiece of claim 9 wherein said detection means consists of a light sensor.

11. The timepiece of claim 9 wherein said detection means consists of a manually operated switch.

12. The timepiece of claim 9 wherein said detection means is arranged to detect the intensity of said biological clock-altering stimuli.

13. The timepiece of claim 9 wherein said input means is also arranged to permit entry of data representing a default operation rate for said timepiece, said input means including means for operating said timepiece at said default operation rate in the absence of said biological clock-altering stimuli.

14. The timepiece of claim 9 wherein said calculation means is also arranged to indicate a time representing the advancement of time at a standard rate.

15. The timepiece of claim 9 wherein said output means comprises means for driving a display for indicating time to said user.

16. A method for continuously providing the current biological time of an individual having a phase response curve and a biological time cycle, said method comprising the steps of receiving an initial biological time of said individual, applying to that time a rate of change based upon said phase response curve of said individual at a given time, and thereupon displaying a time indication corresponding to a new current biological time.

17. The method of claim 16 wherein said step of applying also varies said rate of advancement based upon biological clock-altering stimuli, when present.

18. The method of claim 16 as applied to an individual undergoing a treatment of biological clock-altering stimuli consisting of the application of bright light.

19. The method of claim 16 wherein said individual is undergoing a change of applicable time standards due to travel across time zones which causes said individual to undergo a change in the hours of availability of daylight.

* * * * *